US009326606B2

(12) United States Patent
LaPointe

(10) Patent No.: US 9,326,606 B2
(45) Date of Patent: May 3, 2016

(54) FURNITURE MEMBER POWER MECHANISM WITH ZERO GRAVITY AND REAR TILT POSITIONS

(71) Applicant: La-Z-Boy Incorporated, Monroe, MI (US)

(72) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 295 days.

(21) Appl. No.: 14/031,399

(22) Filed: Sep. 19, 2013

(65) Prior Publication Data

US 2015/0076883 A1 Mar. 19, 2015

(51) Int. Cl.

| | |
|---|---|
| ***A47C 1/024*** | (2006.01) |
| ***A47C 1/032*** | (2006.01) |
| ***A47C 1/0355*** | (2013.01) |

(52) U.S. Cl.

CPC ..... *A47C 1/024* (2013.01); *A47C 1/0242* (2013.01); *A47C 1/0355* (2013.01); *A47C 1/03211* (2013.01)

(58) Field of Classification Search

USPC ..... 297/85 M, 84, 83, 69

See application file for complete search history.

(56) References Cited

U.S. PATENT DOCUMENTS

| | | | | |
|---|---|---|---|---|
| 4,690,457 A | | 9/1987 | Poncy et al. | |
| 4,752,101 A | | 6/1988 | Yurchenco et al. | |
| 4,852,939 A | | 8/1989 | Krauska | |
| 5,061,010 A | | 10/1991 | LaPointe | |
| 5,222,286 A | | 6/1993 | Saul et al. | |
| 5,265,935 A | | 11/1993 | Geisler et al. | |
| 5,288,126 A | | 2/1994 | Saul et al. | |
| 5,312,153 A | * | 5/1994 | Lin | A47C 1/0345 297/68 |
| 5,314,238 A | | 5/1994 | Komorowski et al. | |
| 5,466,046 A | | 11/1995 | Komorowski et al. | |
| 5,480,209 A | * | 1/1996 | May | A47C 1/0352 297/83 |
| 5,482,350 A | | 1/1996 | Komorowski et al. | |

(Continued)

FOREIGN PATENT DOCUMENTS

| | | |
|---|---|---|
| GB | 2280362 A | 2/1995 |
| GB | 2485434 A | 5/2012 |

OTHER PUBLICATIONS

United Kingdom Search Report for GB1416179.8 dated Feb. 27, 2015 (4 pages).

(Continued)

*Primary Examiner* — Sarah McPartlin

(74) *Attorney, Agent, or Firm* — Harness, Dickey & Pierce, P.L.C.

(57) ABSTRACT

A furniture member having a tilt position mechanism includes a base frame positioned on a floor surface. A first operating mechanism is connected to the base frame defining a tilt mechanism. The tilt mechanism includes a tilt motor connected to a rear member of the base frame. A torque tube positioned forward of the tilt motor is displaced by operation of the tilt motor. First and second rotation links are rotatably connected to the base frame and fixed to the torque tube. A pivot tube is positioned rearward of the torque tube and connected by first and second journal links to the support frame. The journal links are shorter than the rotation links such that torque tube forward and upward displacement forwardly rotates the journal links and displaces the pivot tube, creating a furniture member rear tilt position having the torque tube elevated above the pivot tube.

20 Claims, 16 Drawing Sheets

(56) References Cited

U.S. PATENT DOCUMENTS

| | | | | |
|---|---|---|---|---|
| 5,520,439 | A | 5/1996 | Blount | |
| 5,524,303 | A | 6/1996 | Palmer, Jr. et al. | |
| 5,651,580 | A | 7/1997 | LaPointe et al. | |
| 5,730,494 | A | 3/1998 | LaPointe et al. | |
| 5,747,965 | A | 5/1998 | LaPointe et al. | |
| 5,775,775 | A * | 7/1998 | Hoffman | A47C 1/0355 297/316 |
| 5,806,920 | A | 9/1998 | Blount | |
| 5,992,931 | A | 11/1999 | LaPointe et al. | |
| 6,338,531 | B1 | 1/2002 | Hausherr et al. | |
| 6,491,342 | B1 | 12/2002 | Smith | |
| 6,492,786 | B1 | 12/2002 | Vang et al. | |
| 6,659,556 | B2 | 12/2003 | Pellerin | |
| 6,794,841 | B1 | 9/2004 | Vang et al. | |
| 6,823,545 | B1 | 11/2004 | Davis | |
| 7,000,988 | B2 | 2/2006 | Bressler et al. | |
| 7,090,297 | B2 | 8/2006 | Mohn et al. | |
| 7,311,359 | B2 | 12/2007 | Smith | |
| 7,455,360 | B2 | 11/2008 | White et al. | |
| 7,600,817 | B2 | 10/2009 | Kramer et al. | |
| 7,722,114 | B2 | 5/2010 | Smith | |
| 7,766,421 | B2 | 8/2010 | Lawson | |
| 7,850,238 | B2 | 12/2010 | Erb et al. | |
| 2012/0286557 | A1 * | 11/2012 | Hoffman | A47C 1/0355 297/85 M |
| 2013/0257110 | A1 * | 10/2013 | Fischer | A47C 1/0355 297/83 |
| 2014/0333099 | A1 * | 11/2014 | Lu | A47C 1/0355 297/83 |

OTHER PUBLICATIONS

International Search Report for PCT/US2012/052069 dated Feb. 19, 2013.

Written Opinion of the International Searching Authority for PCT/US2012/052069 mailed Feb. 19, 2013.

* cited by examiner

FURNITURE MEMBER POWER MECHANISM WITH ZERO GRAVITY AND REAR TILT POSITIONS

FIELD

The present disclosure relates to furniture members having power actuated mechanisms to move components of the furniture member and extend or retract a leg rest assembly.

BACKGROUND

This section provides background information related to the present disclosure which is not necessarily prior art.

Furniture members such as recliners, sofas, love seats, and ottomans commonly provide a structural frame supporting a body which allows the body to displace forwardly away from a proximate wall such that the back member of the furniture member does not contact the wall during rearward rotation of the back member to a reclining position. The mechanism allowing such simultaneous forward travel during back member rotation does not however also permit a rearward tilt/forward lift motion of the body to a zero gravity position while still maintaining wall clearance at all back member positions.

SUMMARY

This section provides a general summary of the disclosure, and is not a comprehensive disclosure of its full scope or all of its features.

According to several aspects, a furniture member having a tilt position mechanism includes a base frame supporting the furniture member on a floor surface. A first operating mechanism connected to the base frame defines a tilt mechanism. The tilt mechanism includes a tilt motor connected to a rear member of the base frame. A torque tube positioned forward of the tilt motor is displaced by operation of the tilt motor. First and second rotation links are individually rotatably connected to the base frame and fixed to the torque tube. A pivot tube positioned rearward of the torque tube is connected by first and second journal links to the support frame. The first and second journal links are shorter than the first and second rotation links such that forward and upward displacement of the torque tube further rotates the first and second journal links, forwardly displacing the pivot tube and creating a furniture member rear tilt position having the torque tube elevated above the pivot tube.

According to further aspects, a furniture member having a tilt position mechanism includes a base frame supporting the furniture member on a floor surface. A first operating mechanism connected to the base frame defines a tilt mechanism. The tilt mechanism includes a torque tube. First and second rotation links individually rotatably connected to the base frame are fixed to the torque tube. A pivot tube positioned rearward of the torque tube is connected by first and second journal links to the base frame. Forward and upward displacement of the torque tube rotates the first and second journal links and forwardly displaces the pivot tube, creating a furniture member rear tilt position reached when the torque tube is elevated above the pivot tube. A seat back member is rotatably connected to a second operating mechanism. A wall clearance dimension provided between a point of the seat back member to a proximate wall oriented normal to the floor surface is substantially unchanged between a seat back upright position and the furniture member rear tilt position.

According to other aspects, a furniture member having a tilt position mechanism includes a base frame. A first operating mechanism is connected to the base frame defining a tilt mechanism. A second operating mechanism connected to and supported by the tilt mechanism defines a drive mechanism. The tilt mechanism includes a tilt motor connected to a member of the base frame. A drive tube is axially extensible and retractable by operation of the tilt motor. The drive tube is connected to a torque tube. Extension of the drive tube acts to forwardly and upwardly displace the torque tube. First and second rotation links are individually connected to the base frame and to first and second support brackets supporting the drive mechanism. A pivot tube is connected by first and second journal links to the base frame. The first and second journal links are shorter than the first and second rotation links such that forward and upward displacement of the torque tube further rotates and forwardly displaces the first and second journal links, creating a rear tilt position of the furniture member having the torque tube elevated above the pivot tube.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
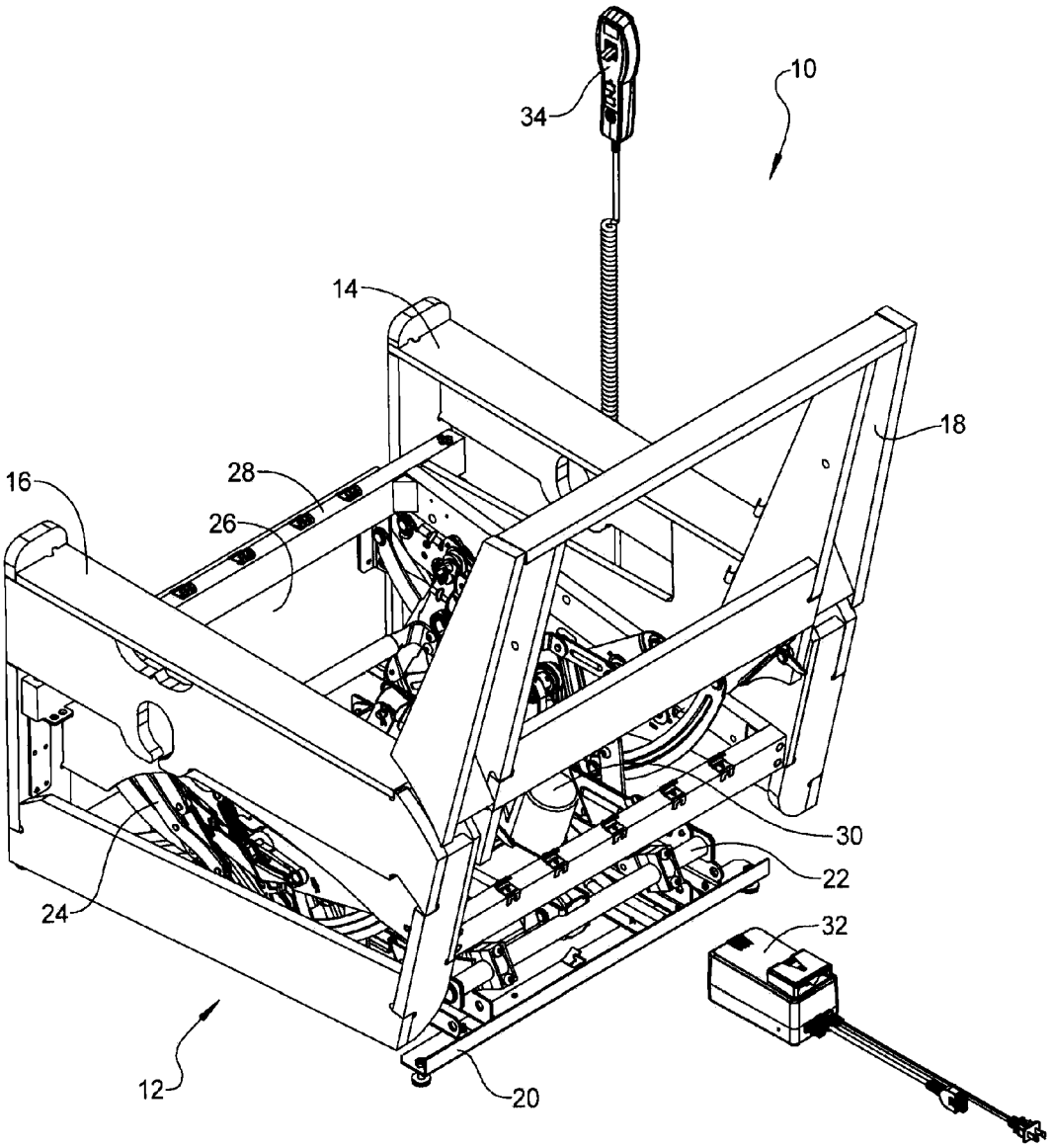
FIG. 1 is a rear perspective view looking forward of a furniture member power mechanism with zero gravity and rear tilt positions.

Referring to FIG. 1, a furniture member 10, which is depicted as a rocking reclining chair, includes a base member 12 which can be framed, for example, using wood or a combination of wood and composite materials and includes each of a first arm rest member 14, defining a right side of furniture member 10 with respect to an occupant seated in the furniture member, and a second armrest member 16, defining a left side. A seat back member 18 is rotatably disposed with respect to the base member 12. The base member 12 and the seat back member 18 are supported on a base frame 20 which can be made, for example, from wood and/or from metal. The base member 12 is rotatable and both tilts and is forwardly displaceable by motion of a pivot tube 22. Pivot tube 22 is located proximate to a lower rear corner of the base frame 20. A leg rest linkage assembly 24 is disposed within the base member 12 and is operated to extend or retract a leg rest member 26, shown in a retracted or stowed position. The leg rest linkage assembly 24 is also positioned below a seat frame 28 which connectively joins the first and second arm rest members 14, 16. A tilt function of furniture member 10, which rotates and displaces base member 12 by motion of pivot tube 22, is directed by actuation of a tilt motor 30, which is also positioned within base member 12 and is supported with respect to the base frame 20. Power to operate the tilt motor 30 is provided via a power converter 32 which can be plugged into a household electrical outlet which converts electrical power for use by the tilt motor 30. For independent operation of the various motions of furniture member 10, a control device 34, such as a handheld switching device, is provided.

Referring to FIG. 2 and again to FIG. 1, the furniture member 10 is shown in an upright position having the leg rest member 26 at its stowed position and the seat back member 18 in a fully upright position, which is reached by rotation of the seat back member 18 with respect to a forward rotation direction "A". The base frame 20 further includes opposed side frame members 36 (only one of which is visible in this view) which can be further provided with a plurality of support feet 38 which allow the orientation of base frame 20 and therefore furniture member 10 to be adjusted with respect to a floor surface 40. In the furniture member upright position, a rearmost point 42, defined as an upper rear corner of the seat back member 18, is positioned with respect to a plane 44 which is spaced from a wall surface 46 by a nominal wall clearance dimension (WCnom) which allows for subsequent displacement of the seat back member 18 during various operating modes of furniture member 10.

Figure 2:
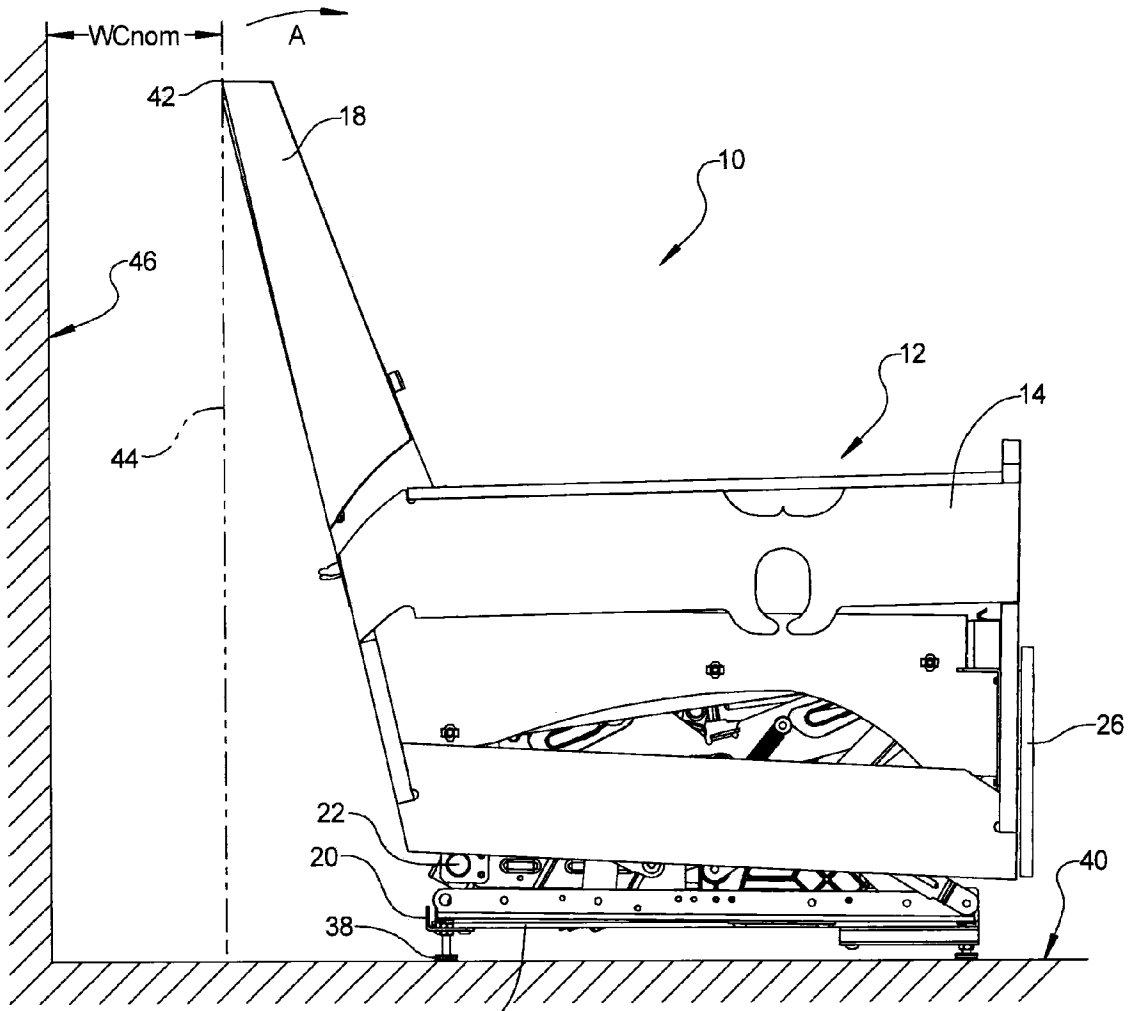
FIG. 2 is a right side elevational view of the furniture member of FIG. 1.

Referring to FIG. 3 and again to FIGS. 1 and 2, components associated with the tilt operation define a tilt mechanism 47 that includes tilt motor 30 and each of a drive housing 48 which directly supports the tilt motor 30, a shaft housing 50 directly connected to the drive housing 48, and an extension shaft 52 which is shown in its fully retracted position and positioned therefore substantially within the shaft housing 50. The extension shaft 52 is connected to a coupling end 54 whose function will be better described in reference to FIG. 4. According to several aspects, the tilt motor 30 and the associated components of tilt mechanism 47 are positioned to one side of a lateral centerline 55 of furniture member 10 and are connected to and supported on the base frame 20.

The side positioning of the tilt motor 30 and tilt mechanism 47 provides space for a centralized position of a drive mechanism 57 having a drive motor 56 which is responsible for extending and retracting the leg rest member 26 as well as rotation of the seat back member 18. The components of drive mechanism 57 are connected to and supported on the tilt mechanism 47. The drive motor 56 is directly connected to a drive housing 58. A slide assembly 60 is slidably disposed on a slide frame 62 which is operably coupled to the drive housing 58. A gear assembly, such as a worm gear (not shown), provided within the slide frame 62 causes a sliding displacement of the slide assembly 60 during operation of drive motor 56. Drive motor 56 can be operated at the same time as tilt motor 30 or can be operated separately from tilt motor 30. The slide assembly 60 is connected to and displaces each of a leg rest linkage assembly 24*a* and a leg rest linkage assembly 24*b*, defining right hand and left hand portions of the leg rest linkage assembly 24. The drive motor 56 is rotatably coupled to pivot tube 22 using a pivot mount 64 to allow for rotation and tilting motions of furniture member 10.

Figure 3:
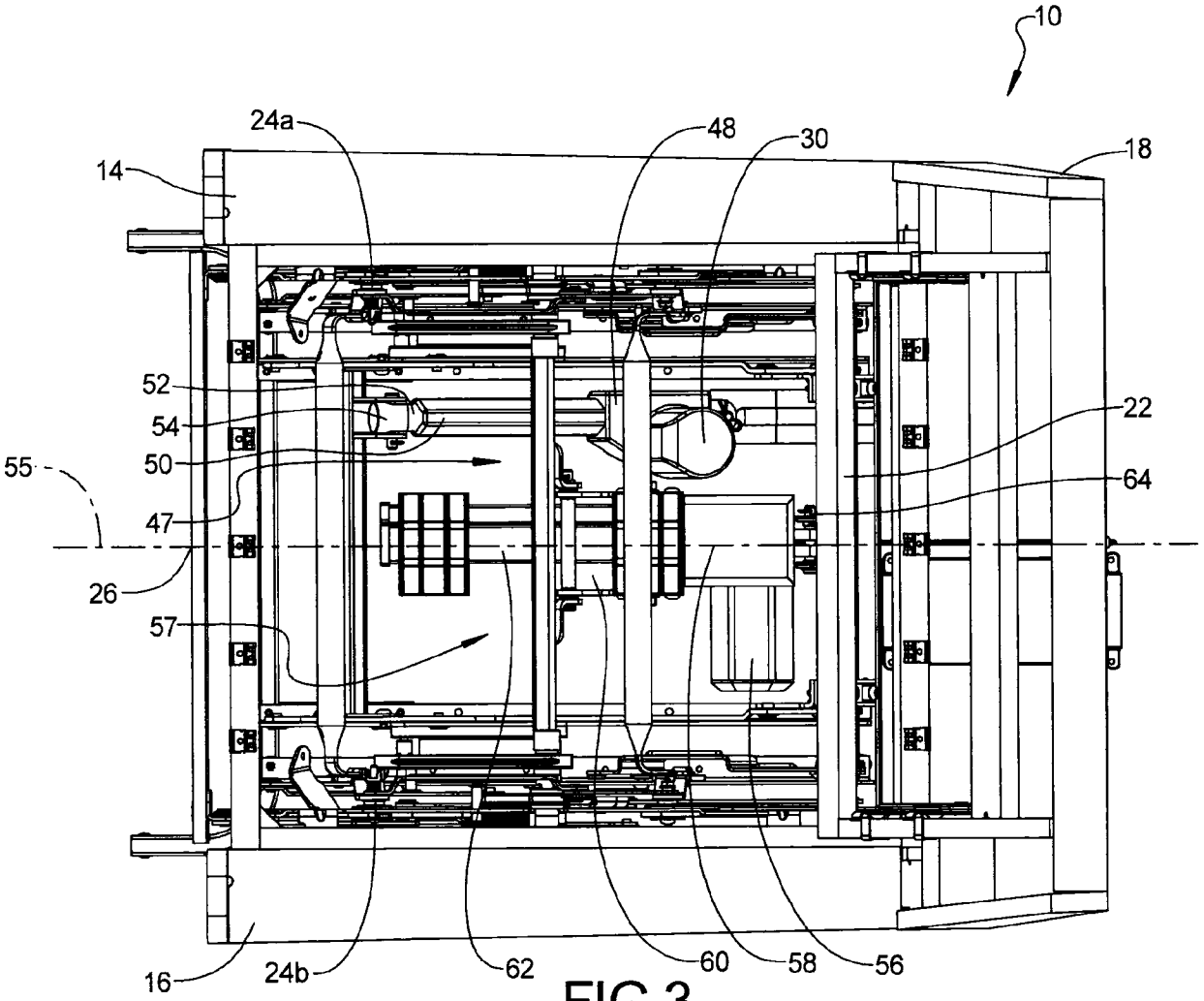
FIG. 3 is a top plan view of the furniture member of FIG. 2.

Referring to FIG. 4 and again to FIGS. 1-3, furniture member 10 is shown following operation of the components of tilt mechanism 47 including tilt motor 30 which repositions the furniture member 10 away from the upright position, shown with respect to FIGS. 1-3, to a rear tilt position shown. Operation of tilt motor 30 causes axial extension of the extension shaft 52 which is rotatably connected to a coupling bracket 66. Axial extension of the extension shaft 52 causes the base member 12 to displace in a forward displacement direction "B" with respect to the base frame 20. Base member 12 also rearwardly tilts in a rearward rotational arc "C" by operation of tilt motor 30. In order to couple the pivot tube 22 to the base frame 20, a first journal bearing 68 and a second journal bearing 70 are fastened to the pivot tube 22. Each of the first and second journal bearings 68, 70 are connected using a first journal link 72 and a second journal link 74, respectively, to individual ones of a first link connecting plate 76 and a second link connecting plate 78. The first link connecting plate 76 is fixed to a first L-shaped frame member 80 of base frame 20. Similarly, the second link connecting plate 78 is fixed to a second L-shaped frame member 82 of base frame 20. The use of the first and second journal bearings 68, 70 permits the pivot tube 22 to both axially rotate and longitudinally displace during operation of tilt motor 30, which will be described in greater detail in reference to FIGS. 14-17.

Figure 4:
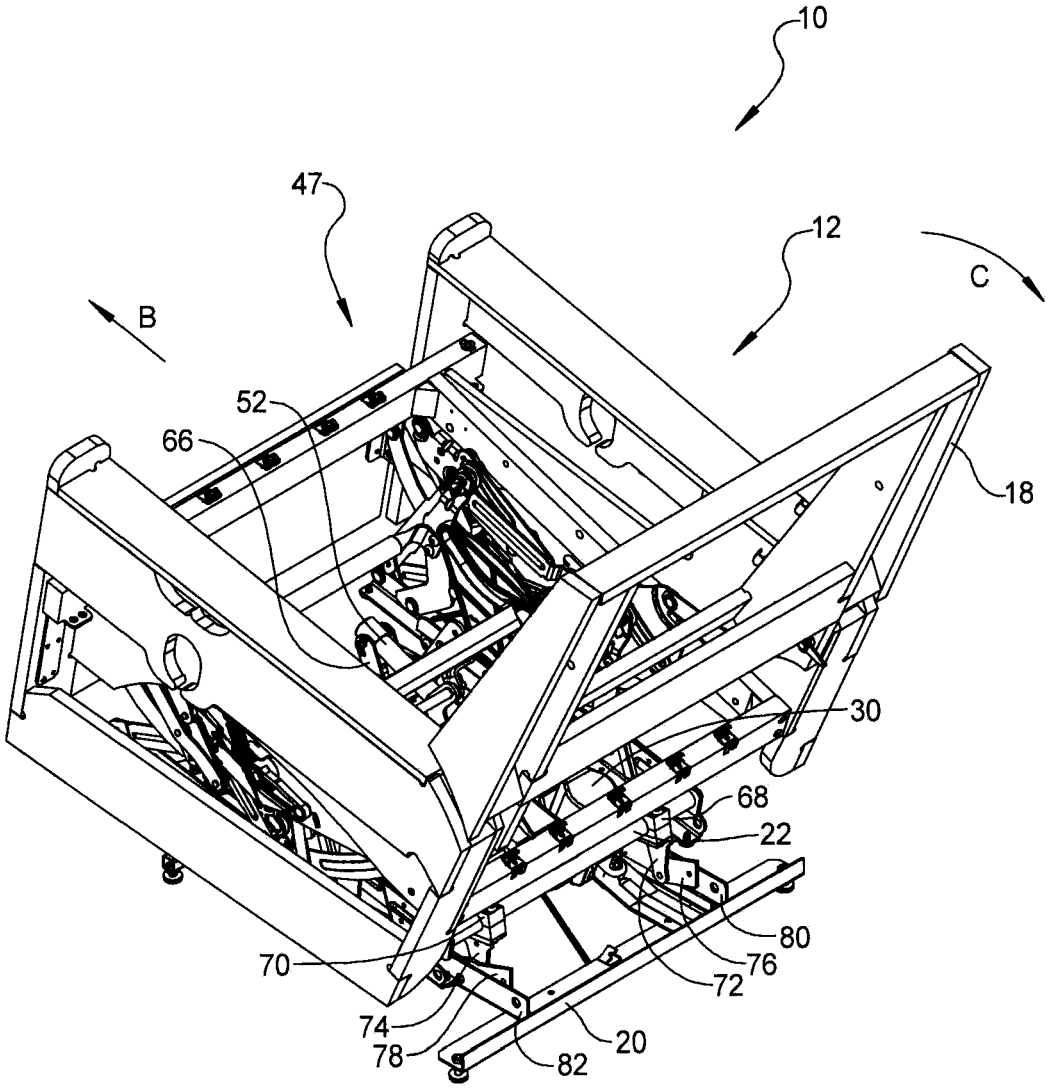
FIG. 4 is a rear perspective view looking forward of the furniture member of FIG. 1 repositioned to a rear tilt position.

Referring to FIG. 5 and again to FIGS. 2 and 4, as base member 12 rotates rearwardly with respect to the rearward rotational arc "C" during operation of tilt motor 30, the seat back member 18 is retained in its fully upright position. Because base member 12 displaces forwardly in the forward displacement direction "B" at the same time that tilt rotation is occurring, the rearmost point 42 does not substantially displace closer to the wall surface 46, thereby providing a wall clearance dimension $WC_1$ which is substantially unchanged from the wall clearance nominal dimension WCnom shown with respect to FIG. 2. To achieve the tilt position of base member 12, operation of tilt motor 30 causes rotation of a first rotation link 84 (a second rotation link 84' positioned on the left side is not clearly visible in this view) which rotates with respect to a first rotational fastener 86 connected to the first L-shaped frame member 80. The forward rotation of the first rotation link 84 changes an orientation of a base member lower surface 88 of base member 12, which raises a base member lower front corner 90 above a base member lower rear corner 92. This orientation of base member lower surface 88 creates an angle of rotation alpha ($\alpha$) between the base member lower surface 88 and the floor surface 40. As previously noted, during the tilt operation, the pivot tube 22 will also displace generally in the forward displacement direction "B". This also helps ensure that the wall clearance $WC_1$ is sufficient to prevent contact between the furniture member and wall surface 46.

Figure 5:
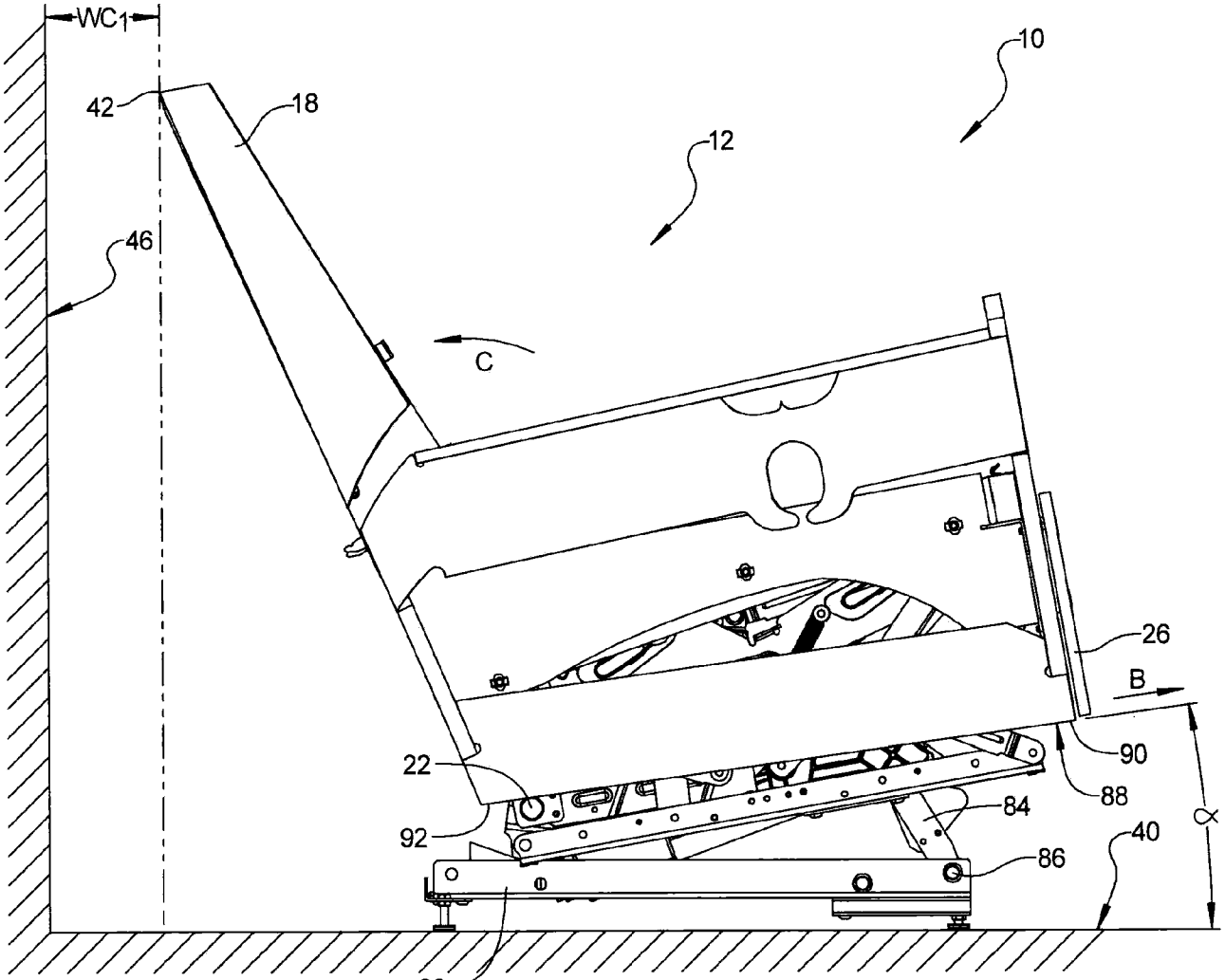
FIG. 5 is a right side elevational view of the furniture member at the rear tilt position of FIG. 4.

Referring to FIG. 6 and again to FIG. 5, with the furniture member 10 positioned in the tilt position, the occupant can select operation of drive motor 56 which, when actuated, slidably displaces the slide assembly 60, as previously described. The slide assembly 60 is linked using a rotational bracket assembly 94 to a drive rod 96. Opposite ends of drive rod 96 are slidably positioned in opposed V-shaped slots 98 (only a right hand V-shaped slot 98 is visible in this view). The V-shaped slots 98 are created in a first wall member 100 on each side of furniture member 10. As the rotational bracket assembly 94 displaces with respect to forward motion of the slide assembly 60, the drive rod 96 is repositioned from a rear end of the V-shaped slot 98 to a central lower position of V-shaped slot 98 shown. During this translation of drive rod 96 within V-shaped slot 98, each of the leg rest linkage assemblies 24*a*, 24*b* outwardly extend in a leg rest extension direction "D", repositioning the leg rest member 26 from the stowed to a fully extended position shown. It is noted that the leg rest member 26 fully extended position is available in the furniture member tilt position shown.

Figure 6:
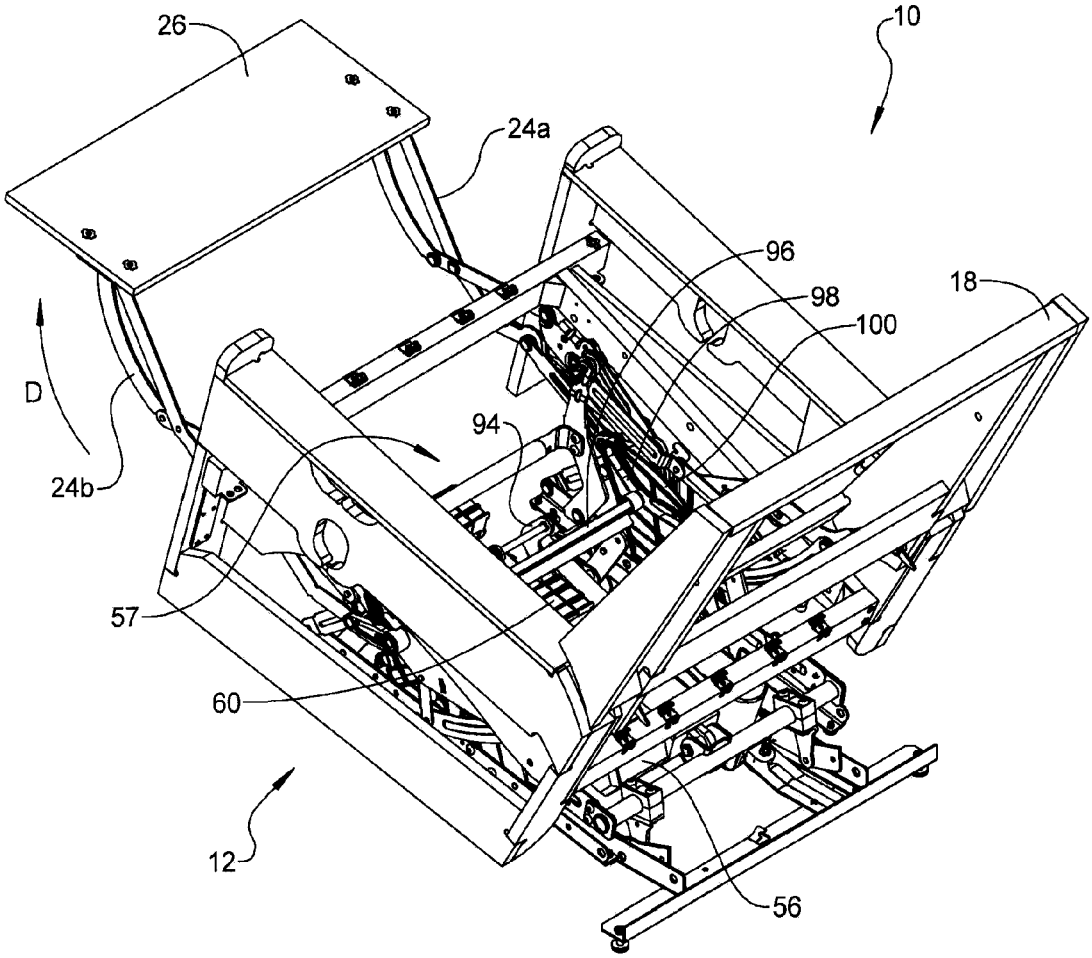
FIG. 6 is a rear perspective view looking forward of the furniture member rear tilt position of FIG. 4 further showing a leg rest assembly fully extended position.
Figure 7:
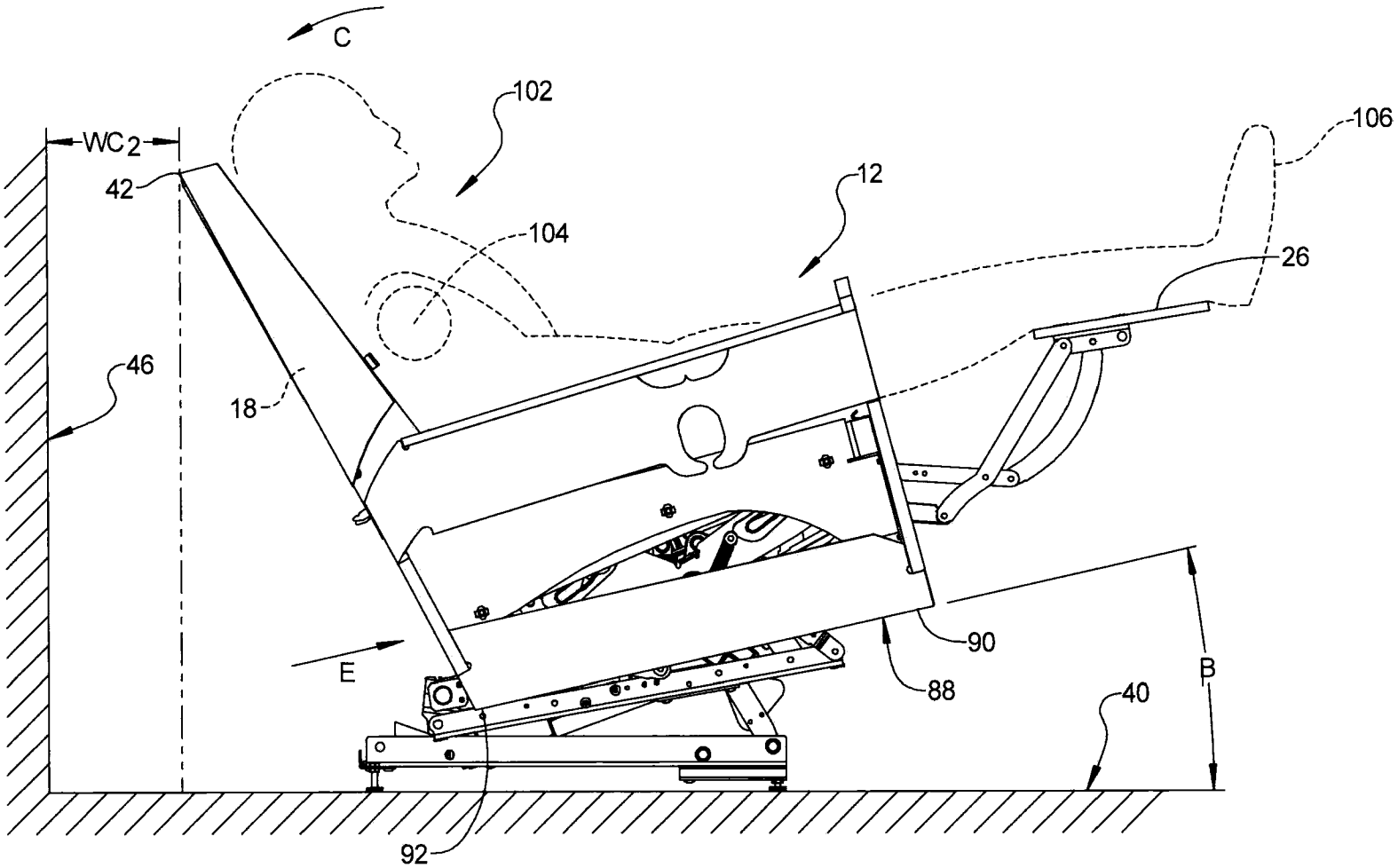
FIG. 7 is a right side elevational view of the furniture member at the rear tilt and leg rest fully extended position of FIG. 6.

Referring to FIG. 7 and again to FIGS. 5 and 6, additional displacement of the base member 12 in a forward elevation/extension direction "E" occurs during leg rest extension. Because the seat back member 18 is retained in its fully upright position during this operation, a wall clearance dimension $WC_2$ is defined when the base member reaches the tilt position and the leg rest member 26 is positioned in its fully extended position. As the leg rest member 26 reaches the fully extended position, the base member lower surface 88 creates an angle $\beta$ (beta) with respect to the floor surface 40. According to several aspects, angle $\beta$ (beta) is greater than angle $\alpha$ (alpha) which is provided with seat tilt only. This additional tilt at the achieved position of angle $\beta$ (beta) helps to position an occupant 102 of furniture member 10 such that a heart elevation 104 of the occupant 102 is positioned substantially level with or below a foot elevation 106 of the occupant 102. As shown in FIG. 7, the base member lower front corner 90 is additionally elevated with respect to the base member lower rear corner 92 which is reduced in elevation with respect to the tilt position shown and described in reference to FIG. 5.

Referring to FIG. 8 and again to FIGS. 6 and 7, as previously noted, the operation of drive motor 56 causes forward displacement of the slide assembly 60 in a slide displacement direction "F". A corresponding forward displacement of the drive rod 96 simultaneously occurs with the forward displacement of slide assembly 60. Operation of the drive motor 56 can be stopped when the leg rest member 26 reaches its fully extended position shown.

Figure 8:
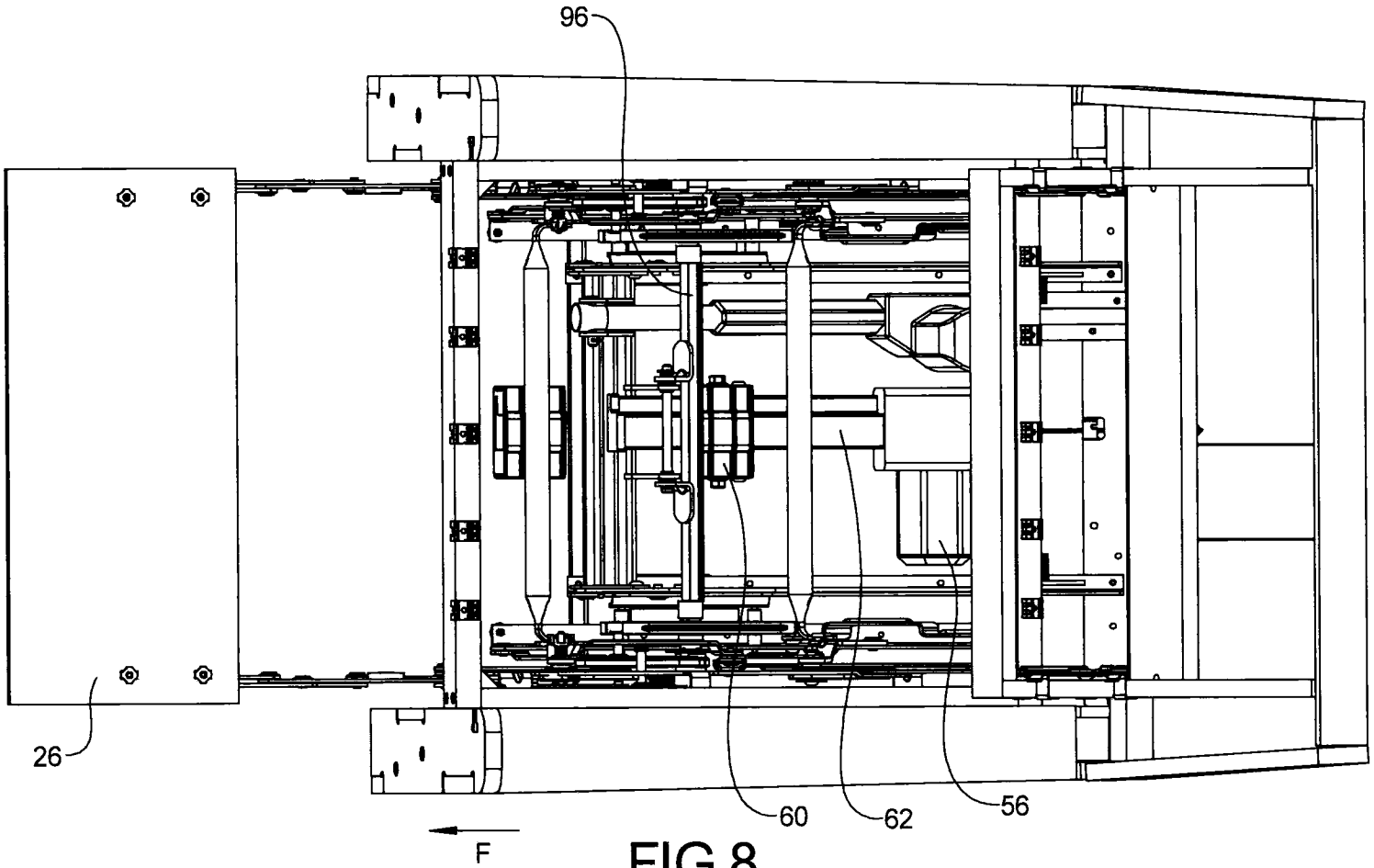
FIG. 8 is a top plan view of the furniture member of FIG. 7.

Referring to FIG. 9 and again to FIGS. 6-8, if the occupant continues to operate the drive motor 56 after leg rest member 26 reaches its fully extended position, continued forward sliding displacement of slide assembly 60 causes displacement of the rotational bracket assembly 94, thereby further forwardly displacing the drive rod 96 until drive rod 96 reaches a forward slot end 108 of V-shaped slot 98. During the continued forward translation of drive rod 96 within the V-shaped slot 98, the forward displacement of drive rod 96 causes a rearward rotation of the seat back member 18 with respect to a seat back recline direction "G". Seat back member 18 recline is directed by displacement of an arc link 110 positioned on opposite right and left hand sides of furniture member 10. Rearward rotation of the seat back member 18 to a fully reclined positioned shown is achieved when the drive rod 96 contacts the forward slot end 108. Some rotation of the first and second journal bearings 68, 70 also occurs during the displacement of leg rest member 26, which is permitted by the rotational connection between drive housing 58 and pivot tube 22 using the pivot mount 64. Additional rotation of each of the first and second journal bearings 68, 70 also occurs during the rotation of seat back member 18.

Figure 9:
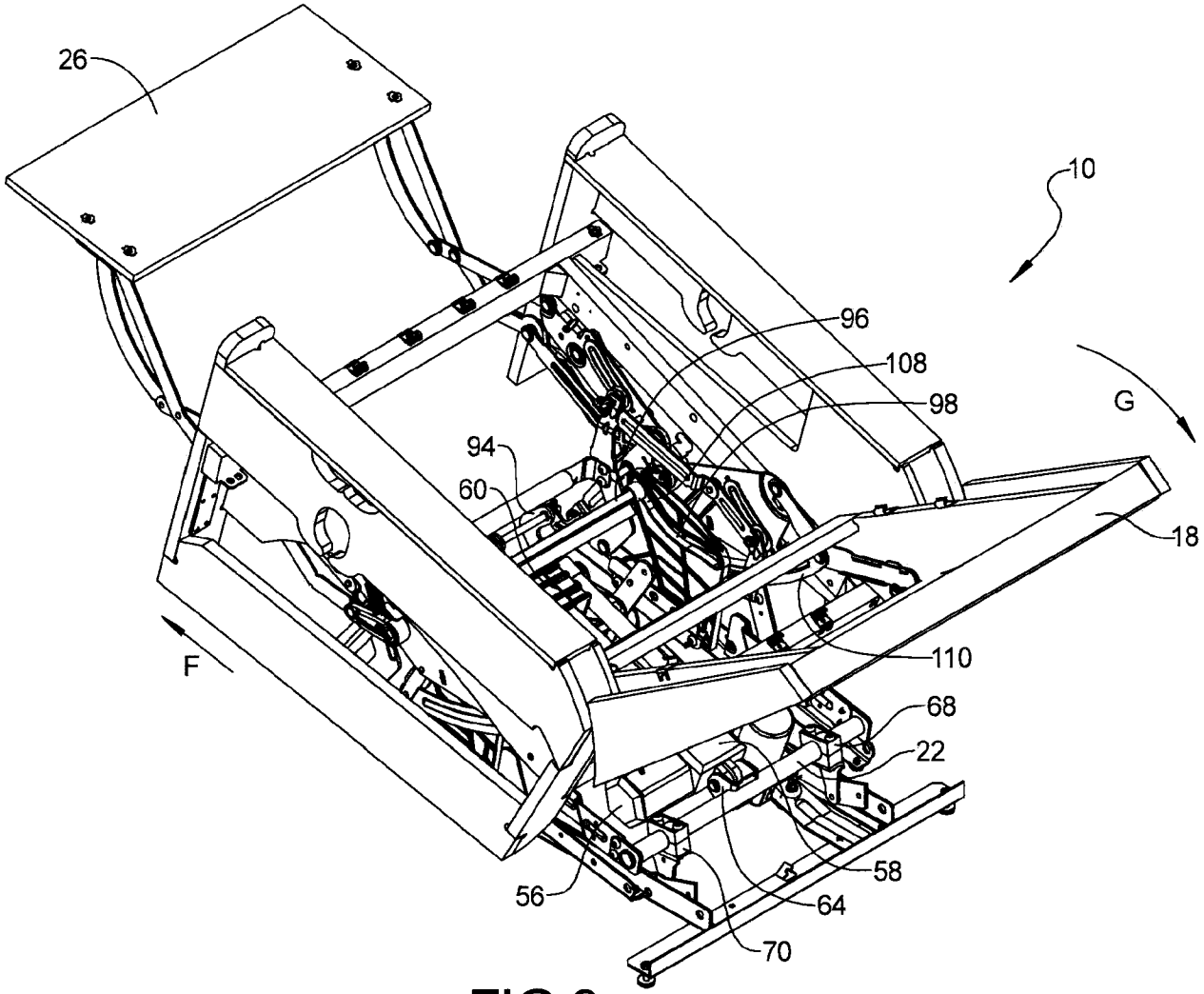
FIG. 9 is a rear perspective view looking forward of the furniture member rear tilt and leg rest fully extended position of FIG. 6 further showing a seat back fully reclined position.

Referring to FIG. 10 and again to FIG. 9, the rearward rotation of seat back member 18 to its fully reclined position shown by rotation with respect to the seat back recline direction "G" positions rearmost point 42 of seat back member 18 at its closest point of approach to wall surface 46, defined as wall clearance WC minimum with respect to wall surface 46. WC minimum is predetermined to provide sufficient clearance for upholstery which is commonly provided on seat back member 18 such that the upholstery also does not contact wall surface 46 at the fully reclined position of seat back member 18. As the seat back member 18 reclines, additional displacement of base member 12 occurs in the forward elevation/extension direction "E". This additional forward extension causes rotation of a second rotation link 112 (a left hand second rotation link 112' is not clearly visible in this view). Second rotation link 112 is rotatably connected to the first L-shaped frame member 80. Due to the forward rotation of second rotation link 112, the base member lower surface 88 is additionally elevated and angled at an angle $\gamma$ (gamma) with respect to the floor surface 40 when seat back member 18 reaches the fully reclined position. According to several aspects, angle $\gamma$ (gamma) is greater than both angle $\beta$ (beta) and angle $\alpha$ (alpha) previously described herein. It is further noted that the base member lower rear corner 92, as well as the base member lower front corner 90, are both additionally elevated with respect to the seat back fully extended position and/or the tilt position of base member 12 previously described herein.

Figure 10:
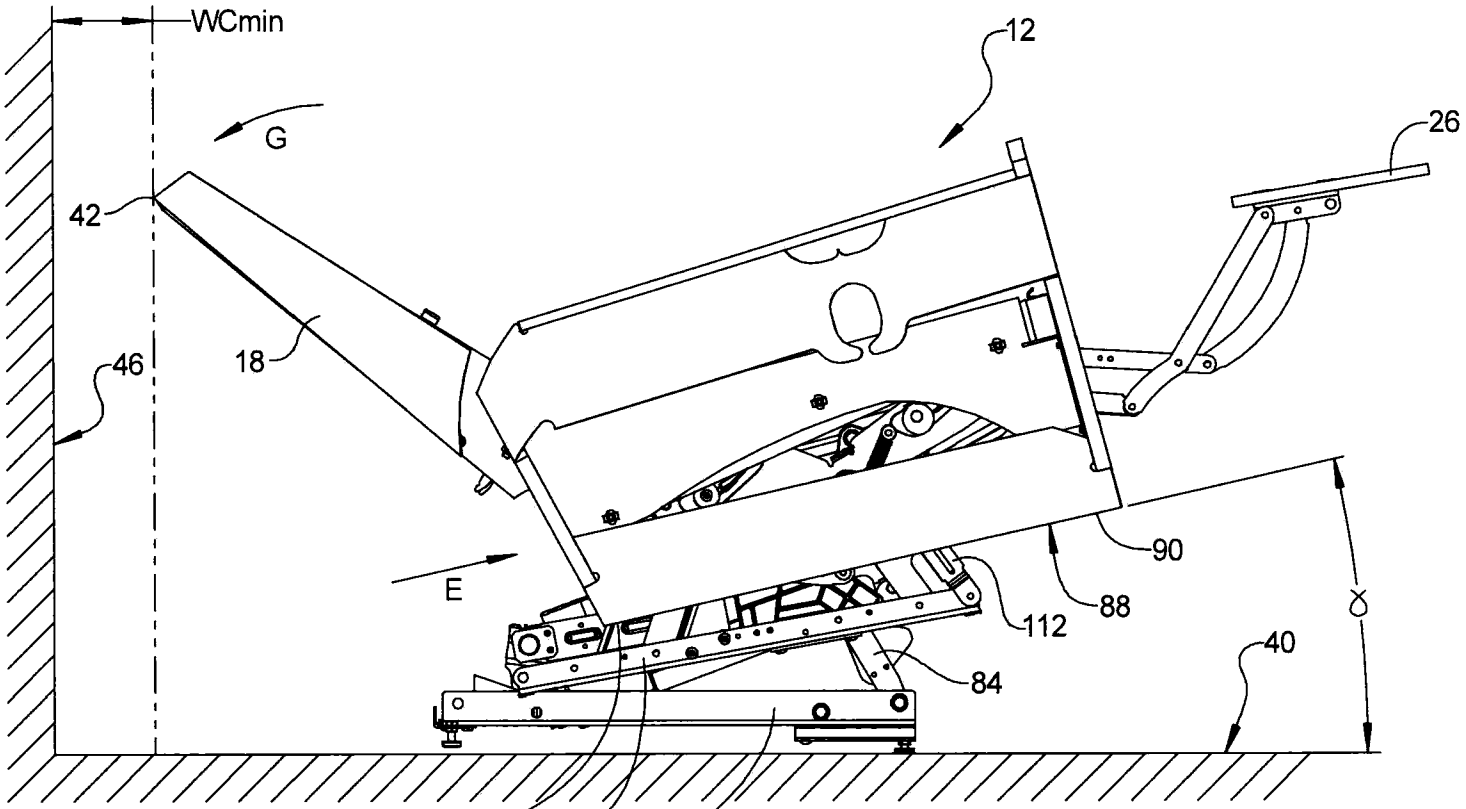
FIG. 10 is a right side elevational view of the furniture member at the rear tilt, leg rest fully extended, and seat back fully reclined position of FIG. 9.
Figure 11:
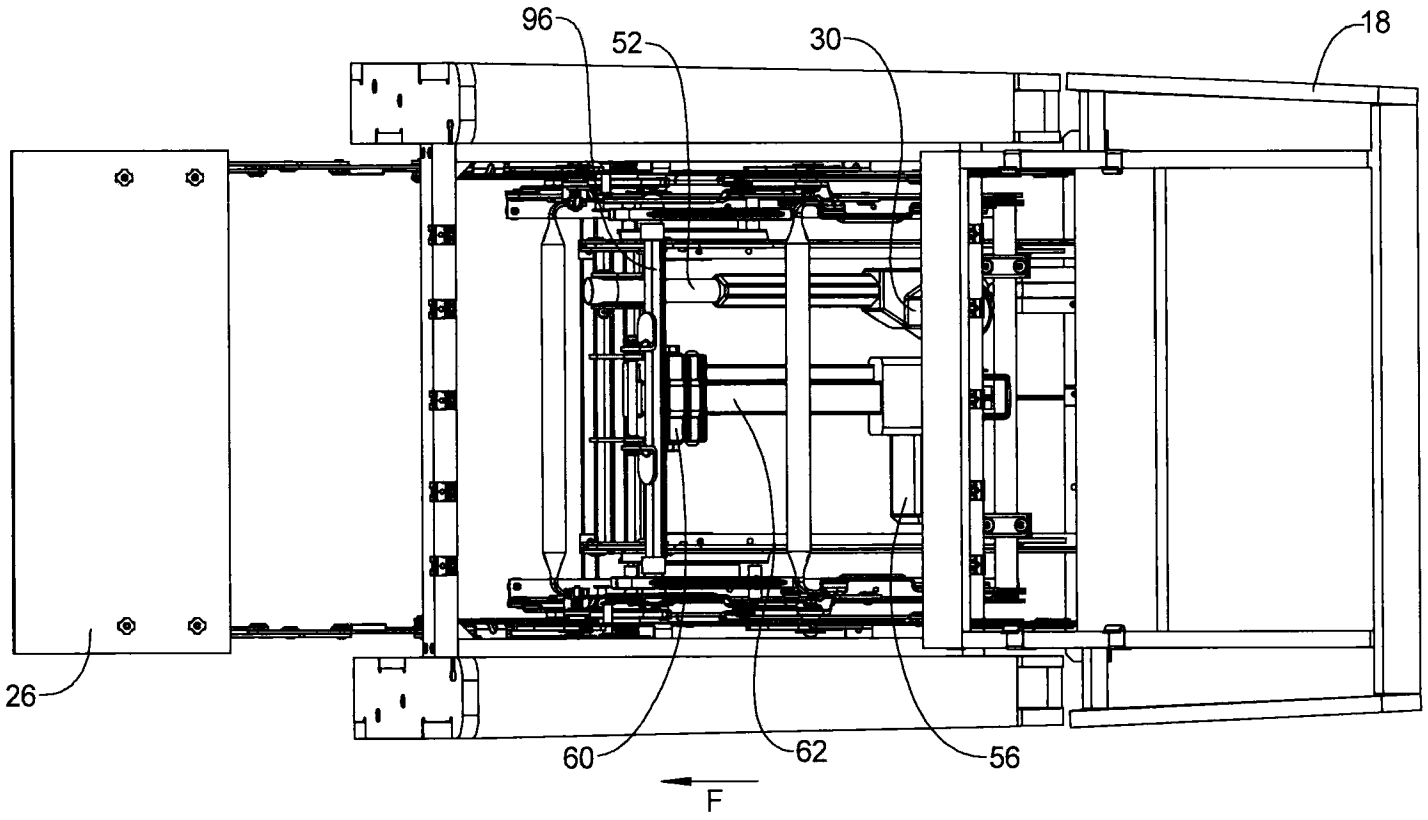
FIG. 11 is a top plan view of the furniture member of FIG. 10.

Referring to FIG. 11 and again to FIG. 10, as the seat back member 18 reaches its fully reclined position with the leg rest member 26 in its fully extended position, the slide assembly 60 reaches a maximum forward displacement in the slide displacement direction "F". As previously noted, the drive rod 96, upon reaching the forward slot end 108 of V-shaped slot 98, stops additional forward displacement of slide assembly 60. Because the base member 12 is also in its full tilt position at this same time, the extension shaft 52 is positioned at its maximum fully extended position. Operation of tilt motor 30 is not required during the period of operation of drive motor 56 to achieve the leg rest fully extended position and/or the seat back member fully reclined position.

Referring to FIG. 12 and again to FIG. 1, prior to achieving any tilt position of base member 12 with respect to base frame 20, the leg rest member 26 can be extended from its stowed position to the fully extended position shown by operation of drive motor 56 alone, and therefore without operation of tilt motor 30. With the base member 12 in its fully upright position, operation of drive motor 56, as previously described, will cause forward displacement of the drive rod 96, thereby extending both of the leg rest linkage assemblies 24*a*, 24*b*. The occupant can therefore select full extension of leg rest member 26 without requiring any tilt position of base member 12.

Figure 12:
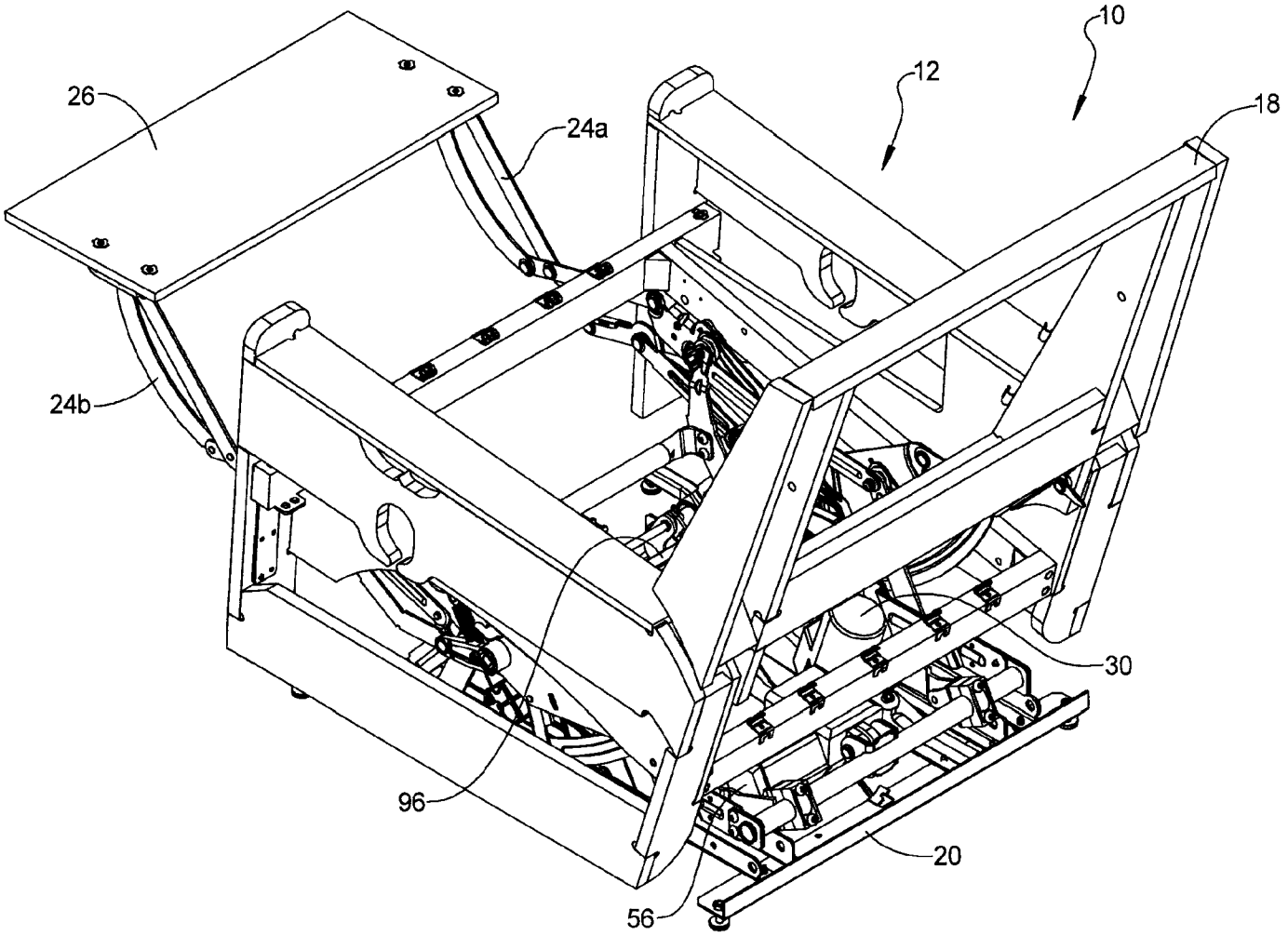
FIG. 12 is a rear perspective view looking forward of the furniture member of FIG. 1 with the leg rest assembly in the fully extended position.
Figure 13:
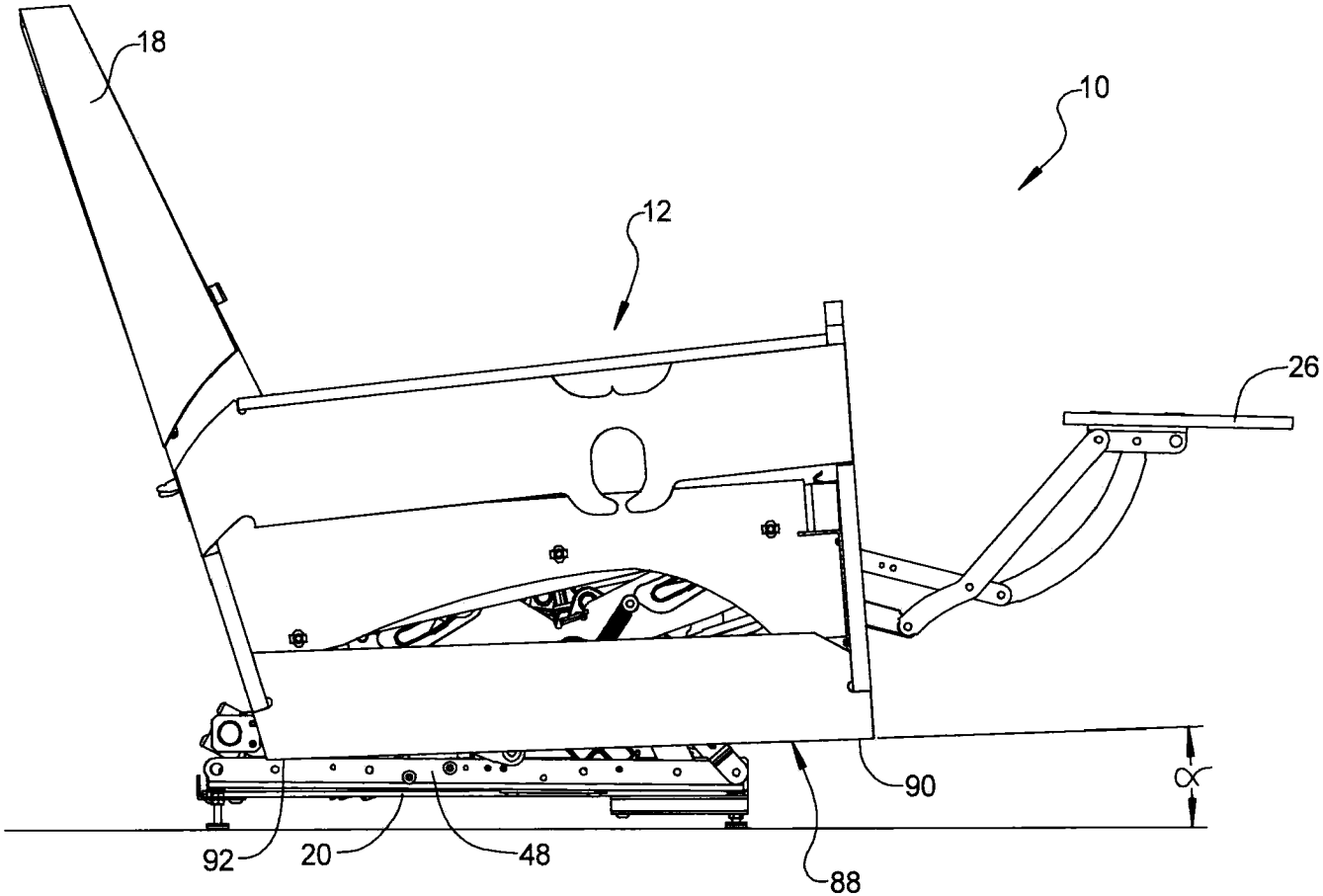
FIG. 13 is a right side elevational view of the furniture member at the leg rest fully extended position of FIG. 12.

Referring to FIG. 13 and again to FIG. 12, during the extension of leg rest member 26, the base member lower surface 88 is repositioned to an angle ɗ (delta) which, according to several aspects, is less than each of angle α (alpha), angle β (beta), and/or angle ɣ (gamma). During this operation, the base member lower rear corner 92 is lowered with respect to the base member lower front corner 90 from the position shown and described with respect to FIG. 2. Although tilt motor 30 is not operational during this extension of leg rest member 26, the base member 12 nonetheless tilts to the angle ɗ (delta) to provide a more comfortable seating position for the occupant of furniture member 10.

Figure 18:
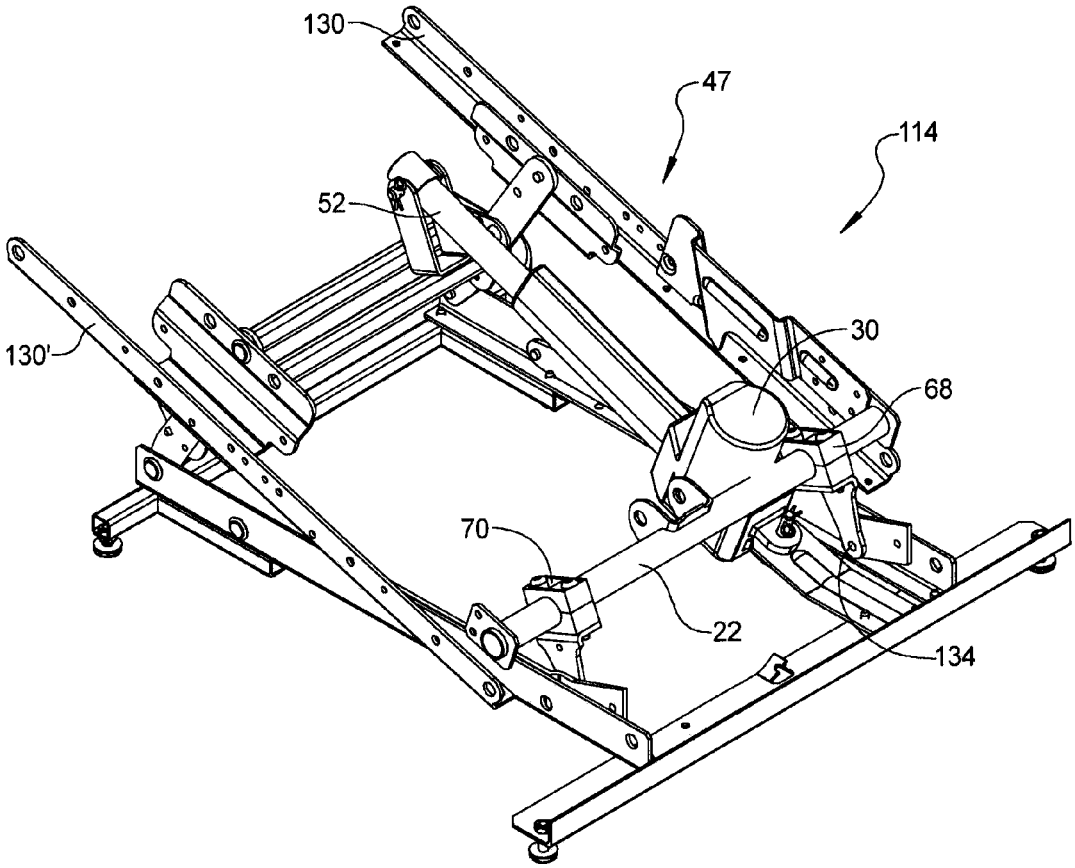
FIG. 18 is a rear perspective view looking forward of the mechanism assembly at the furniture member position of FIG. 6.

Referring to FIG. 14 and again to FIGS. 1-3, components of a tilt mechanism portion 114 define a portion of the overall tilt mechanism 47 for furniture member 10. Tilt mechanism portion 114 includes tilt motor 30, drive housing 48, shaft housing 50, extension shaft 52, and coupling end 54. The components of tilt mechanism portion 114 are connected to a rear frame member 116 of base frame 20 at a rear end (to the right as viewed in FIG. 14) of the furniture member 10 and also to each of a first and second torque tube 118, 120 at a forward end of furniture member 10. According to several aspects, the first and second torque tubes 118, 120 are fixed to each other as well as to oppositely disposed tube attachment plates 122, 122'. The tube attachment plates 122, 122' are, in turn, connected to each of the first rotation links 84, 84'. As previously noted, the first rotation links 84, 84' are each rotatably connected using a first rotational fastener 86, 86' to individual ones of the first and second L-shaped frame members 80, 82. The coupling bracket 66 is fixed to the first and second torque tubes 118, 120 such that axial displacement of extension shaft 52 forwardly and upwardly displaces each of the first torque tube 118, the second torque tube 120, and the tube attachment plates 122, 122'. This displacement causes rotation of each of the first rotation links 84, 84' with respect to the axis defined by first rotational fasteners 86, 86'. A rear end of the drive housing 48 is connected using a clevis 124 and a clevis pin 126 to a motor mount plate 128. Motor mount plate 128 is, in turn, fixed to the rear frame member 116. Use of clevis 124 therefore allows the drive housing 48 to rotate during axial extension or return of extension shaft 52. A first support frame 130 is shown in its connected position to each of pivot tube 22 and a rear end of first support frame 130, as well as to first rotation link 84. An additional second support frame 130', which is connected to the left hand side of tilt mechanism portion 114, is not shown for clarity in FIG. 15, but is shown in FIG. 18.

With continuing reference to FIG. 16 and again to FIGS. 1-6, the support frames 130, 130' (support frame 130' is not shown for clarity) directly support base member 12 and seat back member 18 and the components of drive mechanism 57 that includes drive motor 56 and the components displaced by operation of drive motor 56, including drive housing 48, shaft housing 50, extension shaft 52, and coupling end 54. The support frames 130, 130' are tilted and forwardly displaced by operation of tilt mechanism 47 such that the first and second torque tubes 118, 120 as well as the pivot tube 22 are forwardly displaced during the tilting operation.

Figure 14:
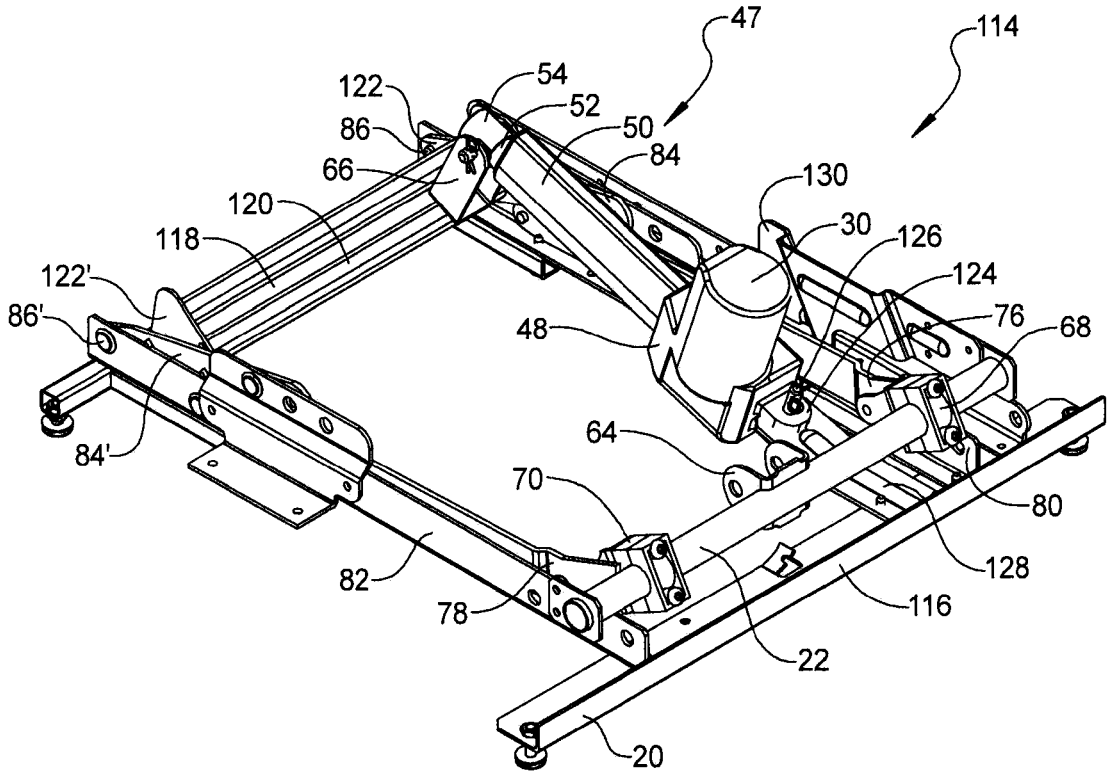
FIG. 14 is a rear perspective view looking forward of only a mechanism assembly of the furniture member of FIG. 1.
Figure 15:
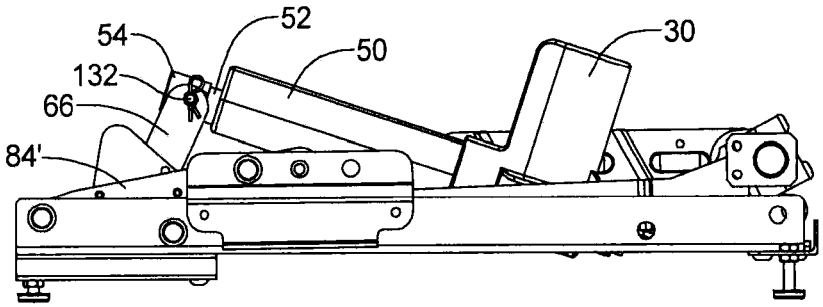
FIG. 15 is a left side elevational view of the mechanism assembly of FIG. 14.

Referring to FIG. 15 and again to FIG. 14, a coupling fastener 132 is used to rotatably couple the coupling end 54 to coupling bracket 66. Coupling fastener 132 allows rotation of coupling bracket 66 as extension shaft 52 is either extended or retracted during operation of tilt motor 30.

Referring to FIG. 16 and again to FIG. 14, tilt mechanism portion 114 is shown following operation of tilt motor 30 to achieve the full tilt position described with reference to FIG. 4. During operation of tilt motor 30, as the extension shaft 52 axially extends from shaft housing 50, the coupling bracket 66 is induced to rotate forwardly, thereby displacing the first and second torque tubes 118, 120 which are coupled to the first rotation links 84, 84'. First and second mount brackets 133, 133' are connected to the first rotation links 84, 84' and define an extent of the tilt mechanism 47, such that tilt mechanism 47 creates a first support portion of furniture member 10. The first and second support frames 130, 130' and the components supported by first and second support frames 130, 130' define a second support portion of furniture member 10. Forward rotation of the first rotation links 84, 84' causes a forward end of the first support frame 130 to upwardly rotate and extend. At this same time, each of the first and second journal bearings 68, 70 also forwardly rotate such that first support frame 130 displaces forward in the forward displacement direction "B". Because the length of first rotation link 84, 84' is greater than a length of the first and second journal links 72, 74, the forward end of first support frame 130 elevates to a greater degree than its rearward end, thereby creating angle α (alpha). The rotation of first and second journal links 72, 74 is provided by use of a journal rotational fastener 134 connecting each to its respective first or second link connecting plate 76, 78.

It is also noted that the first rotation link 84, 84' is rotatably connected using a link rotational fastener 136 to each of the first support frames 130, 130'. A second aperture 138 is also provided proximate to a free end of each of the first rotation links 84, 84'. The purpose of the second apertures 138 is to allow an optional position for the connection of link rotational fasteners 136. By connecting the link rotational fasteners 136 to the second apertures 138, the upward displacement of first and second support frames 130, 130' may be increased with respect to the geometry shown in reference to FIG. 16. This option may be used in furniture members where it is desirous to provide additional rotational angle [greater than angle α (alpha)] for the tilt operation.

Figure 16:
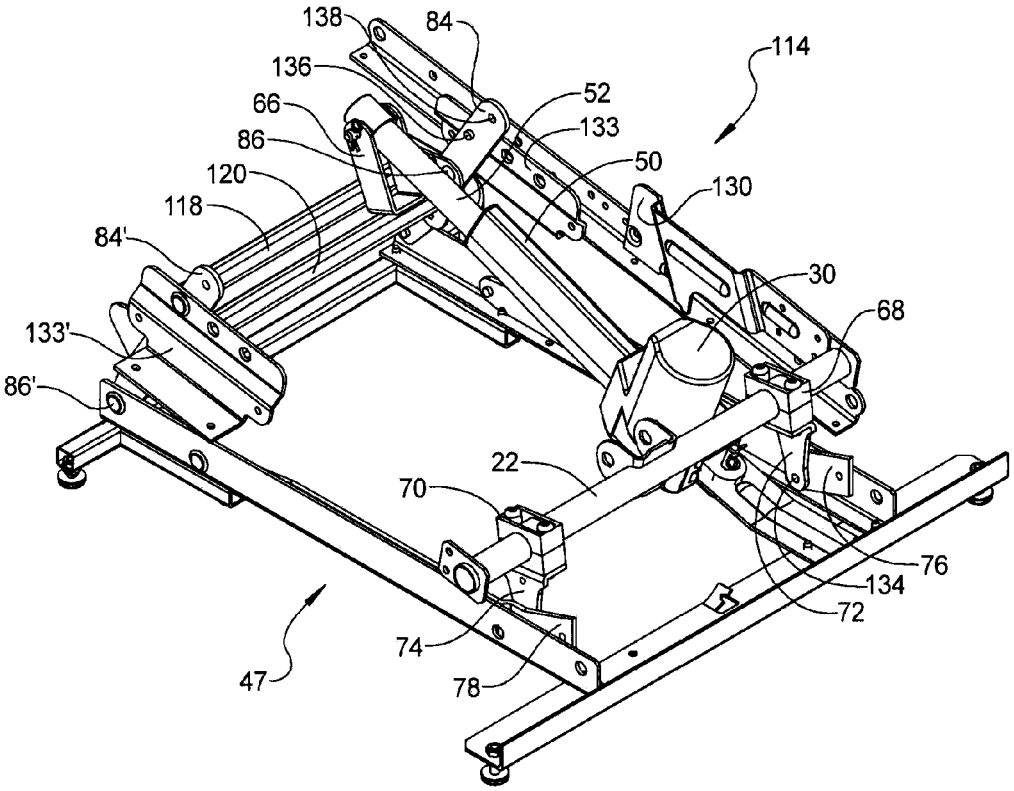
FIG. 16 is a rear perspective view looking forward of the mechanism assembly at the furniture member position of FIG. 4.
Figure 17:
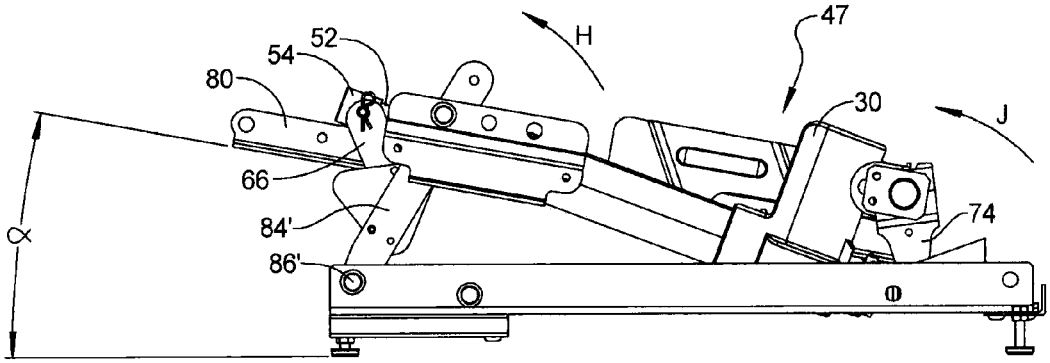
FIG. 17 is a left side elevational view of the mechanism assembly of FIG. 16.

Referring to FIG. 17 and again to FIGS. 5 and 16, as previously described, the outward extension of extension shaft 52 causes forward rotation of first rotation links 84, 84' with respect to first rotational fasteners 86, 86', causing the first rotation links 84, 84' to rotate with respect to a link arc of rotation "H". Similarly, each of the first and second journal links 72, 74 (only second journal link 74 is clearly visible in this view) rotate with respect to a journal arc of rotation "J", which according to several aspects is less than the link arc of rotation "H". The first rotation links 84, 84' are longer than the first and second journal links 72, 74, which provides the degree of tilt angle α (alpha) described in reference to FIG. 5 as the components of tilt mechanism 47 are operated.

Referring to FIG. 18 and again to FIG. 10, the tilt mechanism portion 114 is shown after full rotation or operation of tilt motor 30 achieving full tilt position, as well as after the seat back member 18 has reached the fully reclined position. Extension shaft 52 is fully extended and each of the first and second journal bearings 68, 70 are rotated to their furthest forwardmost locations with respect to journal rotation fasteners 134. Because the axial centerline of pivot tube 22 is now at its furthest forward position with respect to the axis of journal rotational fasteners 134, the elevation of pivot tube 22 is reduced at this furthest forward position of the first and second journal bearings 68, 70.

Figure 19:
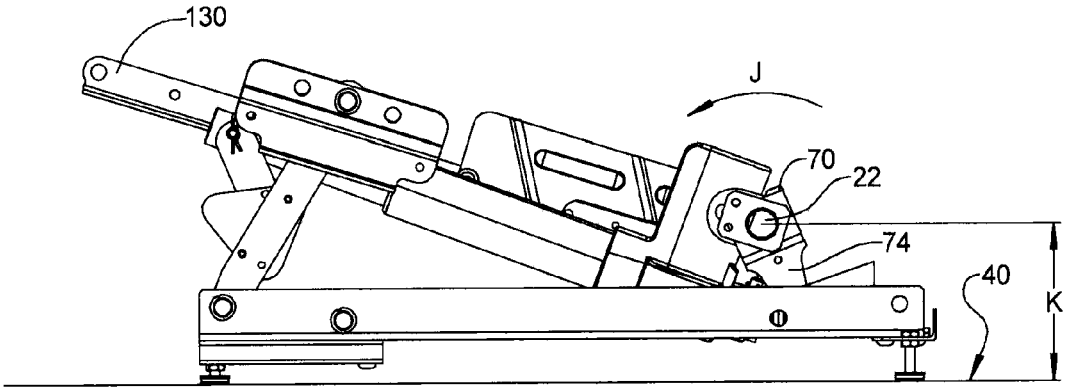
FIG. 19 is a left side elevational view of the mechanism assembly of FIG. 18.

Referring to FIG. 19 and again to FIG. 18, as each of the first and second journal bearings 68, 70 reach their furthest forward rotated position, a longitudinal axis of pivot tube 22 is positioned at an elevation "K" with respect to floor surface 40. This position or elevation "K" is at a minimum at the seat back fully reclined position compared to the full tilt position.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member having a tilt position mechanism, comprising:

a base frame supporting the furniture member on a floor surface; and a first operating mechanism connected to the base frame defining a tilt mechanism, the tilt mechanism including:

a tilt motor connected to a rear member of the base frame;

a torque tube positioned forward of the tilt motor and displaced by operation of the tilt motor;

first and second rotation links individually rotatably connected to the base frame and fixed to the torque tube; and a pivot tube positioned rearward of the torque tube and connected by first and second journal links to the base frame, the first and second journal links being shorter than the first and second rotation links such that forward and upward displacement of the torque tube further rotates the first and second journal links forwardly displacing the pivot tube, creating a furniture member rear tilt position having the torque tube elevated above the pivot tube; and a second operating mechanism connected to and supported on the tilt mechanism, the second operating mechanism defining a drive mechanism having a drive motor operating to extend and retract a leg rest assembly.

2. The furniture member having a tilt position mechanism of claim 1, further including first and second support brackets connected to the first and second rotation links supporting the drive mechanism from the tilt mechanism.

3. The furniture member having a tilt position mechanism of claim 2, further including:

first and second support frames individually connected to one of the first and second support brackets;

a base member connected to the first and second support frames having the leg rest assembly rotatably connected thereto; and a seat back member rotatably connected to the second operating mechanism and rotated by operation of the drive motor independently of the extension or retraction of the leg rest assembly.

4. The furniture member having a tilt position mechanism of claim 1, further including a clevis connected to the pivot tube rotatably connecting the drive motor to the pivot tube such that the drive motor moves together with the tilt mechanism.

5. The furniture member having a tilt position mechanism of claim 1, wherein the drive motor is operated independently of the tilt motor such that extension and retraction of the leg rest assembly can be performed concurrent with operation of the tilt mechanism or without actuation of the tilt mechanism.

6. The furniture member having a tilt position mechanism of claim 1, further including a drive tube axially extensible and retractable by operation of the tilt motor, the drive tube connected to the torque tube, extension of the drive tube acting to forwardly and upwardly displace the torque tube.

7. The furniture member having a tilt position mechanism of claim 1, wherein the first and second rotation links are individually rotatably connected to the pivot tube using one of a first and second journal bearing.

8. The furniture member having a tilt position mechanism of claim 1, further including a seat back member rotatably connected to the second operating mechanism rotatable by operation of the drive motor, a wall clearance dimension provided between a point of the seat back member to a proximate wall being substantially unchanged between a seat back upright position and the furniture member rear tilt position.

9. A furniture member having a tilt position mechanism, comprising:

a base frame supporting the furniture member on a floor surface;

a first operating mechanism connected to the base frame defining a tilt mechanism, the tilt mechanism including:

a torque tube;

first and second rotation links individually rotatably connected to the base frame and fixed to the torque tube; and a pivot tube positioned rearward of the torque tube and connected by first and second journal links to the base frame, forward and upward displacement of the torque tube rotating the first and second journal links and forwardly displacing the pivot tube, creating a furniture member rear tilt position reached when the torque tube is elevated above the pivot tube; and a seat back member rotatably connected to a second operating mechanism, a wall clearance dimension provided between a point of the seat back member to a proximate wall oriented normal to the floor surface being substantially unchanged between a seat back upright position and the furniture member rear tilt position, wherein the second operating mechanism includes a drive motor operating to rotate the seat back member independently of the tilt position.

10. The furniture member having a tilt position mechanism of claim 9, wherein the first and second journal links are shorter than the first and second rotation links such that a base member lower surface of an occupant base member supported by the tilt mechanism is oriented at an angle of approximately 11 degrees with respect to the floor surface at the furniture member rear tilt position.

11. The furniture member having a tilt position mechanism of claim 9, wherein the tilt mechanism includes a tilt motor connected to a rear member of the base frame, the torque tube being positioned forward of the tilt motor and displaced by operation of the tilt motor.

12. The furniture member having a tilt position mechanism of claim 9, wherein the second operating mechanism is connected to and is supported on the tilt mechanism, the drive motor of the second operating mechanism operating to extend and retract a leg rest assembly and to rotate the seat back member.

13. The furniture member having a tilt position mechanism of claim 9, wherein the second drive mechanism includes a drive rod displaced during operation of the drive motor, the drive rod connected to a leg rest assembly extensible and retractable in either of the furniture member rear tilt position or a furniture member upright position.

14. The furniture member having a tilt position mechanism of claim 9, further including a base member connected to the tilt mechanism having a leg rest assembly connected thereto, wherein an angle defined between a base member lower surface of the base member and the floor surface at the furniture member rear tilt position increases as the leg rest assembly is extended.

15. A furniture member having a tilt position mechanism, comprising:

a base frame;

a first operating mechanism connected to the base frame defining a tilt mechanism and a second operating mechanism connected to and supported by the tilt mechanism, the second operating mechanism defining a drive mechanism;

the tilt mechanism including:

a tilt motor connected to a member of the base frame;

a drive tube axially extensible and retractable by operation of the tilt motor, the drive tube connected to a torque tube, extension of the drive tube acting to forwardly and upwardly displace the torque tube; and first and second rotation links individually connected to the base frame and to first and second support brackets supporting the drive mechanism; and a pivot tube connected by first and second journal links to the base frame, the first and second journal links being shorter than the first and second rotation links such that forward and upward displacement of the torque tube further rotates and forwardly displaces the first and second journal links creating a rear tilt position of the furniture member having the torque tube elevated above the pivot tube; and a base member connected to the drive mechanism and movable by operation of a drive motor of the drive mechanism.

16. The furniture member having a tilt position mechanism of claim 15, further including a leg rest assembly connected to the drive mechanism extensible from a stowed position to a fully extended position by operation of the drive motor.

17. The furniture member having a tilt position mechanism of claim 16, further including a seat back member connected to the drive mechanism and rotatable with respect to the base member between a seat back upright position and a fully reclined position following displacement of the leg rest assembly to the fully extended position.

18. The furniture member having a tilt position mechanism of claim 15, wherein the base member is both forwardly displaced and rearwardly rotated with respect to the pivot tube during extension of the drive tube.

19. The furniture member having a tilt position mechanism of claim 15, further including a seat back member connected to the drive mechanism rotatable between a seat back upright position and a fully reclined position, wherein a wall clearance dimension between a point of the seat back member to a proximate wall oriented normal to a floor surface supporting the furniture member is substantially unchanged between the seat back upright position and the furniture member rear tilt position.

20. The furniture member having a tilt position mechanism of claim 15, wherein the torque tube is positioned forward of the tilt motor and acts during operation of the tilt motor to raise a front corner of the furniture member.

* * * * *